US005295862A

United States Patent [19]

Mosquera

[11] Patent Number: 5,295,862

[45] Date of Patent: Mar. 22, 1994

[54] CONNECTOR BOARDLOCK

[75] Inventor: Rene A. Mosquera, Laguna Niguel, Calif.

[73] Assignee: ITT Corporation, Secaucus, N.J.

[21] Appl. No.: 777,556

[22] Filed: Dec. 16, 1991

[51] Int. Cl.[5] ..... H01R 13/60

[52] U.S. Cl. ..... 439/567; 29/845; 439/82; 439/83

[58] Field of Search ..... 439/82, 83, 81, 507, 439/554, 557, 567; 29/845

[56] References Cited

U.S. PATENT DOCUMENTS

| | | | |
|---|---|---|---|
| 2,687,862 | 8/1954 | Crowther | 248/27 |
| 2,823,932 | 2/1958 | Schigut | 285/162 |
| 2,863,131 | 1/1955 | Carlzen et al. | 339/193 |
| 2,897,474 | 7/1959 | Heath | 339/128 |
| 3,324,450 | 6/1967 | Winyard et al. | 339/128 |
| 3,777,303 | 12/1973 | McDonough | 339/258 |
| 4,477,142 | 10/1984 | Cooper et al. | 339/125 |
| 4,534,603 | 8/1985 | Brown et al. | 339/17 |
| 4,662,699 | 5/1987 | Vachhani et al. | 339/97 |
| 4,717,219 | 1/1988 | Frantz et al. | 439/82 |
| 4,795,353 | 1/1989 | Baker | 439/92 |
| 4,824,398 | 4/1989 | Taylor | 439/557 |
| 4,842,552 | 6/1989 | Frantz | 439/557 |
| 4,865,555 | 9/1989 | Assini et al. | 439/82 |
| 4,889,502 | 12/1989 | Althouse et al. | 439/607 |
| 5,209,681 | 5/1993 | Brown | 439/83 X |

*Primary Examiner*—Eugene F. Desmond
*Attorney, Agent, or Firm*—Thomas L. Peterson

[57] ABSTRACT

A boardlock is provided for holding down the housing of an electrical connector to a circuit board, which can be constructed at low cost and which assures good electrical and mechanical connection between the connector housing and circuit board. The boardlock is designed to be pushed downwardly through a cylindrical hole in a connector flange and through a larger diameter cylindrical hole drilled into the circuit board. The boardlock is formed from a piece of sheet metal which is bent to form largely tubular upper and lower portions (40, 42, FIG. 2 ) received respectively in the flange hole and in the larger diameter board hole, with largely vertical edges of the bent sheet metal engaging the walls of the hole. The boardlock has a pair of horizontal separation slots (76, 78) extending a limited distance from each vertical edge to separate the upper and lower portions, to allow the edge regions (86, 88) of the lower tubular portion to be bent to a larger radius of curvature to engage the walls of the larger circuit board hole. A vertical middle portion (62) of the boardlock has a projecting bump (60) on the lower tubular portion to center the lower tubular portion in the circuit board hole. The lower tubular portion forms a pair of fingers (56, 58) that lie within the top of the circuit board hole, and which press against the lower surface of the housing flange. The tapered bottom portions of the boardlock have slits forming ramps to which solder adheres, so any pullout forces cause compression of some of the solder.

14 Claims, 6 Drawing Sheets

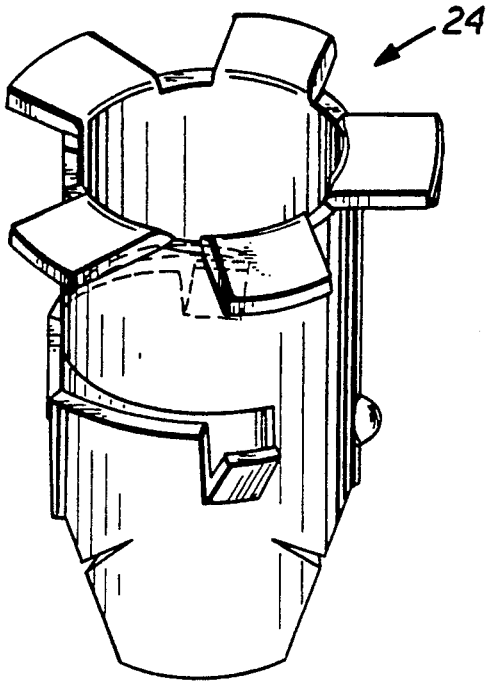
FIG. 3
FIG. 4
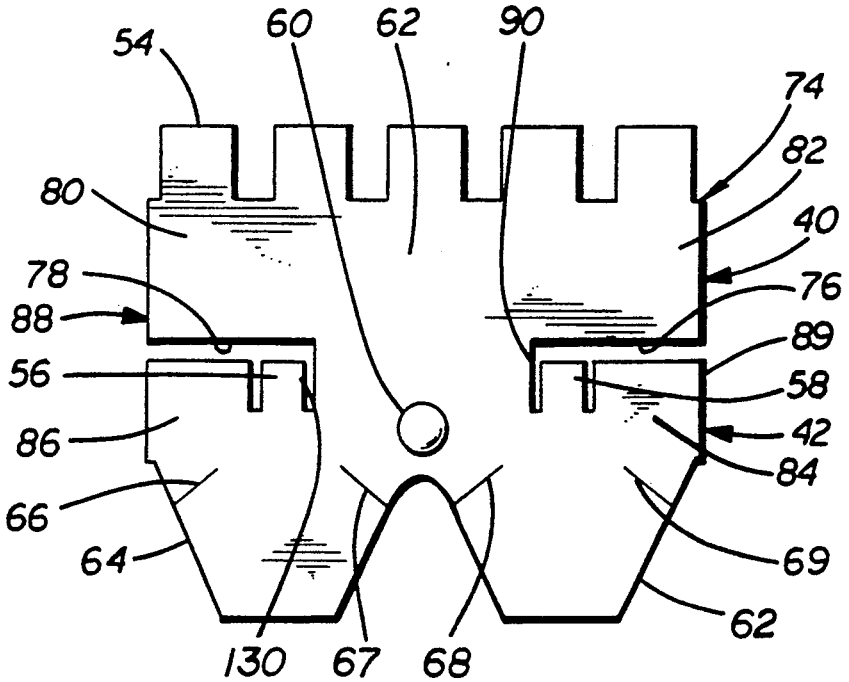

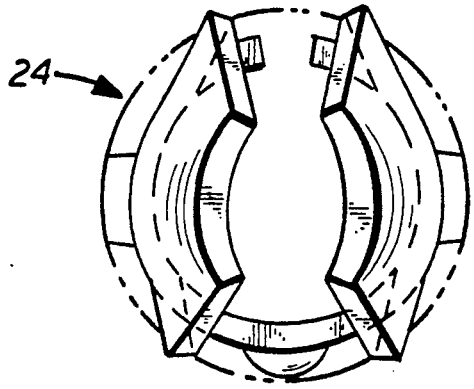
FIG. 7
FIG. 8
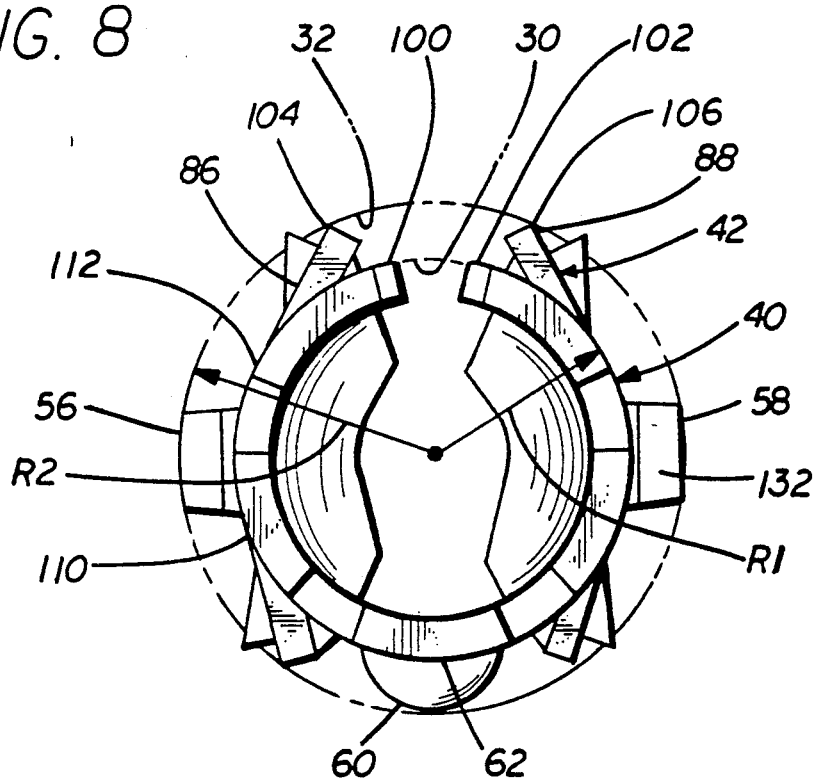

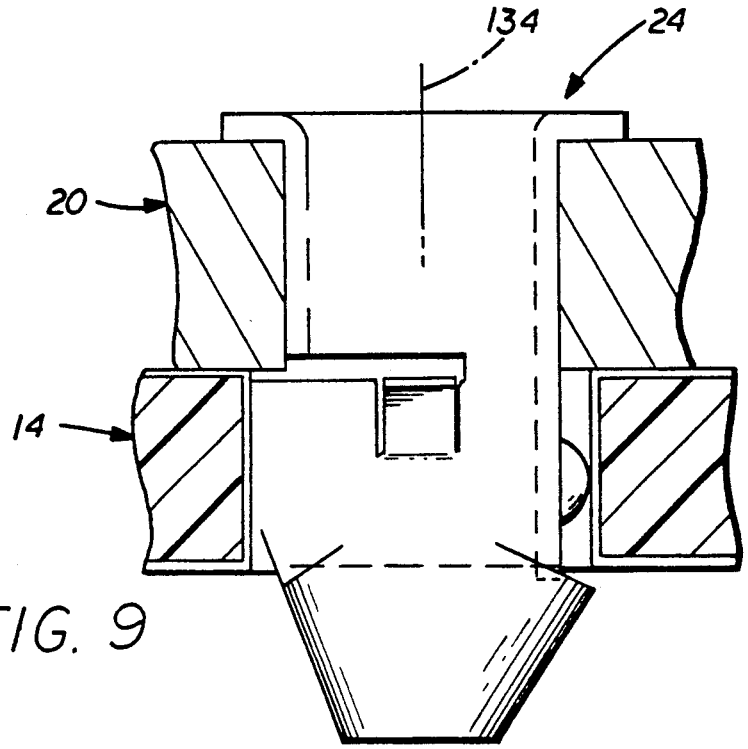
FIG. 9
FIG. 10
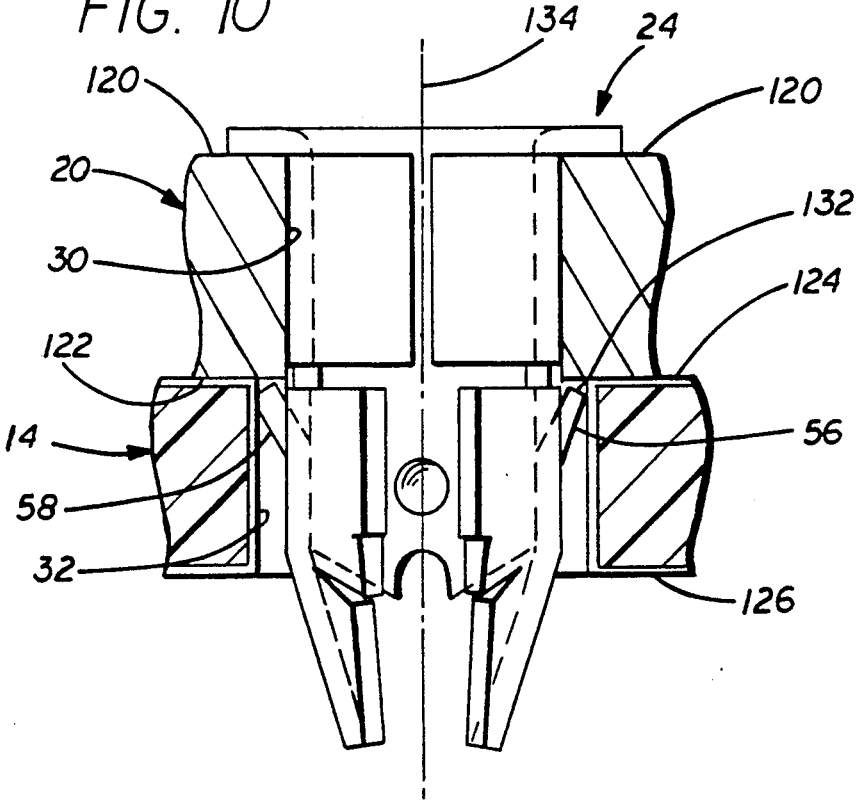

CONNECTOR BOARDLOCK

BACKGROUND OF THE INVENTION

One type of electrical connector has a housing designed to mount directly against the upper surface of a circuit board, with the connector contacts having termination ends engaged with conductive traces on the circuit board. The connector housing can be held to the circuit board by a pair of boardlocks that pass through holes in a pair of housing flanges and through corresponding holes that have been drilled into the circuit board. In most cases, the circuit board holes have been plated, with some of the plating coating the walls of the hole and additional portions lying on upper and lower faces of the board around the hole, to establish the board hole and connector housing at ground potential. With the boardlocks installed, the electrical connections between the connector and board may be soldered as by wave soldering. Each boardlock preferably has portions that abut both the upper and lower portions of the flange to lock securely to the connector during handling and shipment to the customer who will assemble it to the circuit board. Each boardlock also preferably makes firm contact with plated walls of the circuit board hole at several locations. In addition, the boardlock should offer high resistance to pullout from the circuit board in the final assembly. A boardlock which could be constructed at low cost and which provided the above features, would be of considerable value.

SUMMARY OF THE INVENTION

In accordance with one embodiment of the present invention, a low cost boardlock is provided which can be inserted through holes in a connector flange and in a circuit board to securely hold the connector and board together while assuring good electrical connection between them. The boardlock is designed to fit through a connector flange hole of a first diameter and a board hole of a second larger diameter. The boardlock is formed from a piece of sheet metal that is bent around a vertical axis to form largely tubular upper and lower hole-received portions that are received respectively in the flange hole and the larger board hole. A pair of horizontal separator slots extend from each edge of the sheet metal partially around the boardlock to allow edge regions of the lower tubular portion to be bent to a larger radius of curvature to fit tightly in the larger circuit board hole. The vertical middle portion of the boardlock, where the tubular upper and lower portions are not separated by a slot, preferably has at least one radially outward projection as in the form of a bump; the bump lies in the tubular lower portion to center it in the board hole. The tubular lower portion has slits forming a pair of fingers that extend at upward and radially outward inclines so the upper surfaces of the fingers substantially abut the lower surface of the flange. A bottom portion of the boardlock is tapered and has inclined slits that form ramps that can lie substantially under the lower board surface and which are soldered thereto, so any upward pullout force on the boardlock tends to compress solder lying between the ramp and the bottom surface of the circuit board.

The novel features of the invention are set forth with particularity in the appended claims. The invention will be best understood from the following description when read in conjunction with the accompanying drawings.

BRIEF DESCRIPTION OF THE DRAWINGS

FIG. 3 is a left side and top isometric view of the boardlock of FIG. 2.

FIG. 4 is a plan view of a piece of sheet metal which has been cut out, and which can be bent to form the boardlock of FIG. 2.

FIG. 7 is a view taken on the line 7—7 of FIG. 5.

FIG. 8 is a view taken on the line 8—8 of FIG. 5.

FIG. 9 is a sectional view of the boardlock of FIG. 6, with the tabs folded, shown installed on a connector housing and circuit board, but prior to a final soldering operation.

FIG. 10 is a sectional side view of the arrangement of FIG. 9, but taken on a view perpendicular to that of FIG. 9.

DESCRIPTION OF THE PREFERRED EMBODIMENT

Figure 1:
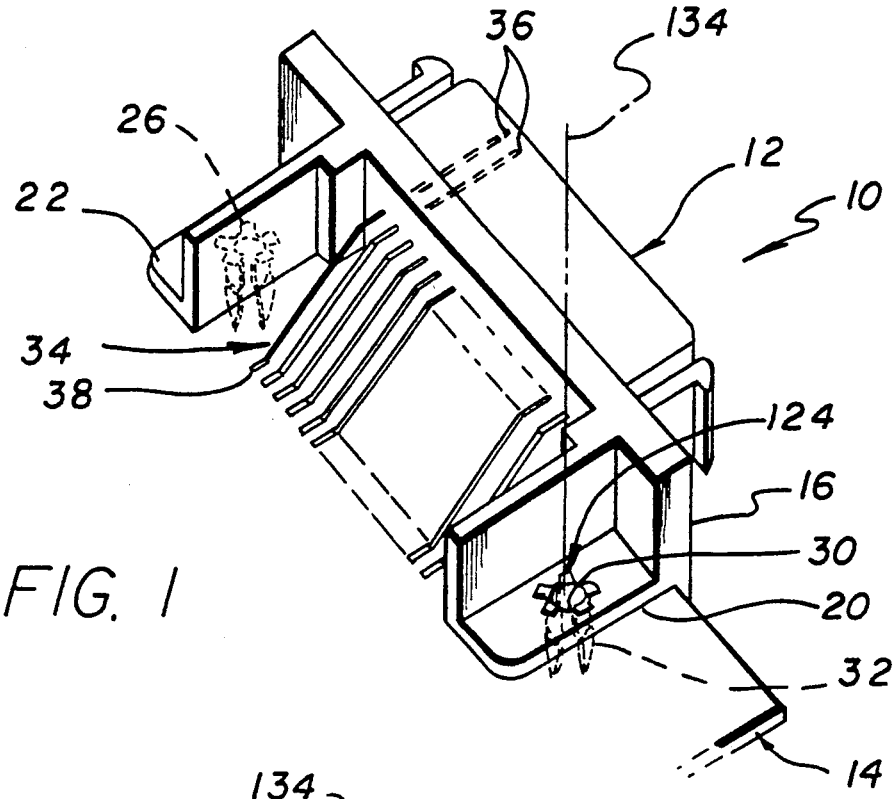
FIG. 1 is an isometric view showing a connector installed on a circuit board by the use of boardlocks, all constructed in accordance with the present invention.

FIG. 1 illustrates an assembly 10 of an electrical connector 12 and a circuit board 14. The connector 12 has a housing 16 that includes a pair of flange elements or flanges 20, 22 that have lower surfaces that lie facewise against the upper surface of the circuit board element or circuit board. A pair of identical boardlocks 24, 26 each extend through aligned holes 30, 32 in the connector flange and in the circuit board to mechanically and usually electrically connect them together. The connector 12 is of the type that has multiple contacts 34 with mating ends 36 that mate with the contacts of another connector, and with termination ends 38 that bear against conductive traces (not shown) on the upper surface of the circuit board and which will eventually be soldered thereto. It should be noted that terms such as "upper", "lower", "vertical", etc. are used herein only to aid in the description of the invention, and that the parts can be used in any orientation with respect to gravity.

Figure 2:
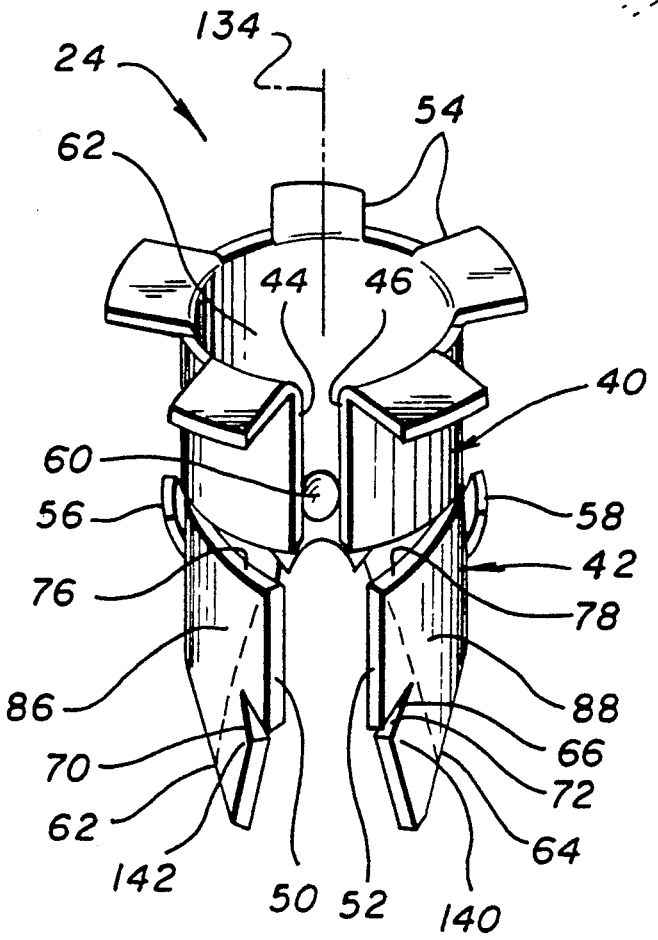
FIG. 2 is a front and top isometric view of one of the boardlocks of FIG. 2, ready to be installed.
Figure 5:
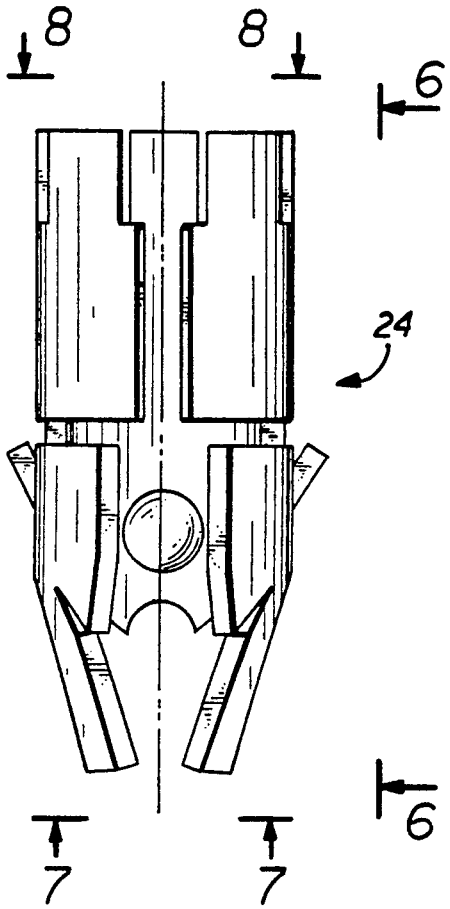
FIG. 5 is a front elevation view of the boardlock of FIG. 2, but with the top tabs not folded to the horizontal.
Figure 6:
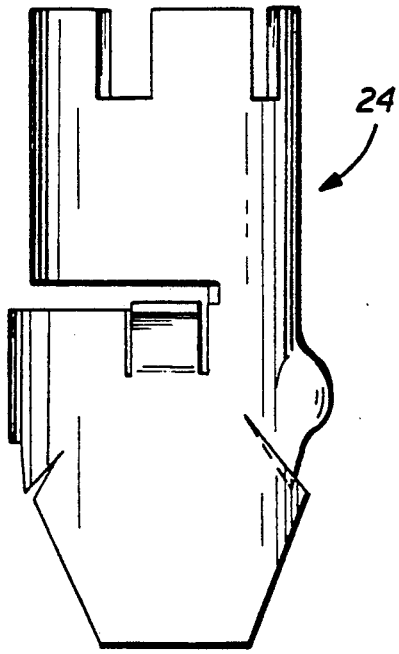
FIG. 6 is a view taken on the line 6—6 of FIG. 5.

FIG. 2 illustrates details of the boardlock 24. The boardlock 24 is formed of a piece of sheet metal that was originally flat, but which has been bent to form largely tubular upper and lower hole-received portions 40, 42. The tubular upper portion 40 is designed to lie tightly within the flange hole, while the tubular lower portion 42 is designed to lie tightly within the circuit board hole. The tubular upper portion 40 has a pair of adjacent largely vertical edge portions or edges 44, 46 that are designed to bear firmly against the walls of the flange hole, while the tubular lower portion has a pair of adjacent lower edges 50, 52 that are designed to bear firmly against the walls of the circuit board hole. It is noted that it is not necessary that each edge be sharp, but can even be bent-around. The boardlock has five tabs 54 at the top which bear against the upper surface of the connector flange. The tubular lower portion 42 has a pair of fingers 56, 58 designed to substantially abut the lower surface of the flange to prevent upward pullout of the boardlock from the connector flange. The tubular lower portion also has a bump 60 along the vertical middle region or middle 62 of the boardlock, to help center the tubular lower portion in the larger circuit board hole. The boardlock has a pair of bottom tapered parts 62, 64 which facilitate insertion of the boardlock. Each bottom tapered part has slits such as 66 which form a pair of largely upwardly-facing ramps or abutments 70, 72 which can abut solder used in the final assembly. Each of these features will be discussed below.

FIG. 4 illustrates the piece of sheet metal 74 which has been blanked from a larger sheet, and which is to be bent into the form shown in FIG. 2. The sheet metal has a pair of separator slots 76, 78 that divide part of the tubular upper portion from the tubular lower portion. The separator slots 76, 78 leave a pair of upper edge regions 80, 82 which are separated from a pair of lower edge regions 84, 86. Each edge region extends from a boardlock vertical edge 88, 89 to the bottom 90 of a corresponding slot. The bottoms 90 of the slots are widely spaced apart, to leave a wide vertical middle 62 where the tubular upper and lower portions merge and which constitutes about one-third the width of the sheet metal.

FIG. 8 shows a bottom view of the boardlock of FIG. 2, showing it in relation to the holes 30, 32 in the flange and in the circuit board. It can be seen that the tubular upper portion is bent to a radius of curvature R1 so the tubular upper portion extends largely in a circle. Contact with the walls of the flange hole is made at the corners 100, 102 and at the vertical middle 62. The tubular lower portion 42 has a middle which is substantially a vertical extension of the middle of the tubular upper portion. However, the lower edge regions 84, 86 are bent so part of each extends substantially straight to leave corners 104, 106 that engage the walls of the circuit board hole 32. The average radius of curvature of a lower edge region such as 86 is much larger than the average radius of curvature of the upper portion 40. The radius of curvature of the region 86 can be considered to be the radius of curvature of an imaginary circle that lies on point 110 at the bottom of the separation slot, on a point at 104 formed by the edge, and on a point 112 that is halfway in between the other two points. The bump 60 serves to provide three points of contact (at bump 60 and edges 104, 106) to position the tubular lower portion 42 in the circuit board hole, so the boardlock tends to remain untilted, that is, so its axis tends to remain vertical and coincident with the axis of the flange and board holes. Without the bump 60, the lower part of the vertical middle would tend to be pressed towards the walls of the hole.

FIG. 10 shows the boardlock 24 installed in the holes 30, 32 of the connector flange 20 and of the circuit board 14. The flange has upper and lower surfaces 120, 122, while the circuit board has upper and lower surfaces 124, 126. The boardlock is initially installed in the flange 20 and the connector is shipped with the boardlock in place, to the customer. The customer has holes drilled in his circuit board, and presses the connector with the boardlocks thereon, downwardly so the boardlocks enter the holes in the circuit board. The two fingers 56, 58 are each formed by a pair of slits 130 (FIG. 4) on the lower side of each separation slot 76, 78. As shown in FIG. 10, each finger is bent so its upper end 132 lies further from the axis 134 of the boardlock than the lower end of the finger. The upper end of each finger lies at the upper end of the circuit board hole, and lies substantially abutting the lower face 122 of the flange. Thus, once the boardlock has been pressed downwardly through the flange and circuit board, the boardlock is locked in place against upward pullout of the flange. The fact that the hole 32 in the circuit board is larger (preferably at least 5 percent larger) than the hole in the flange, results in providing room at the bottom surface 122 of the flange beyond its hole 30, against which the finger upper ends 132 can press.

Figure 11:
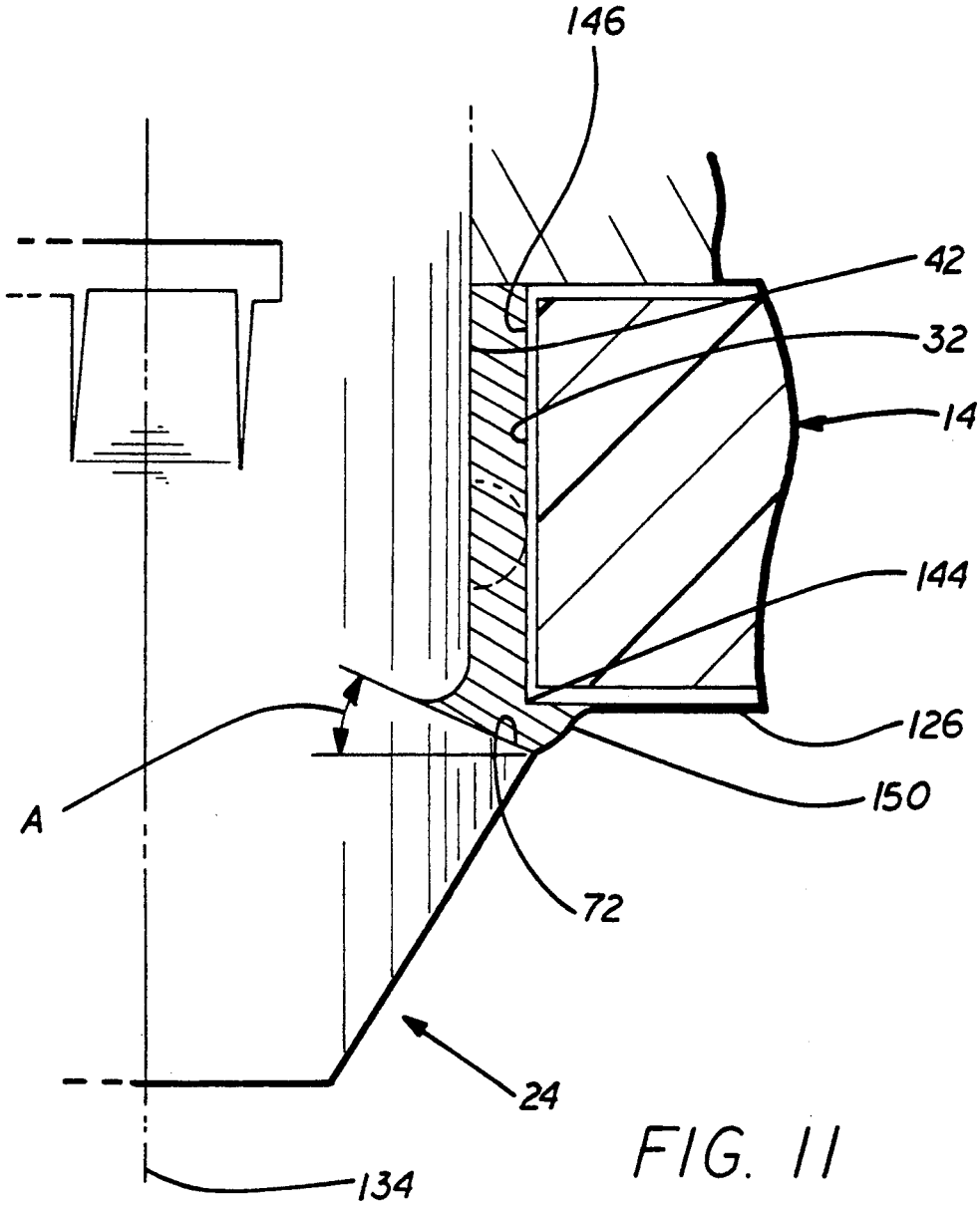
FIG. 11 is an enlarged view of a portion of FIG. 9, with the boardlock fully soldered in place.

As shown in FIG. 4, slits 66–69 are formed at opposite sides of each bottom tapered part 62, 64. As shown in FIG. 2, the portion under each slit such as 66 forms a bottom tab 140 which is bent further from the axis 134 than the lower edge region such as 86 lying above the slit 66. This results in the upwardly-facing ramp or abutment 70, 72. Referring to FIG. 11, the upwardly-facing abutment 72 is bent sufficiently that it lies either directly below the bottom surface 126 of the circuit board 14 at its point of intersection 144 with the hole 32, or lies very close thereto. After the connector with boardlocks has been installed, the circuit board may be subjected to wave soldering, which results in filling the gap 146 between the tubular lower portion 42 and the walls of the circuit board hole 32 with solder. One trapped solder portion 150 lies between the abutment 72 and the corner 144, by lying either directly below it or close to a position directly below it. When an upward force is applied to the boardlock 24, the trapped portion 150 is subjected to compression force between the abutment 72 and the board lower surface 126. Tin lead solder is weak in shear, but is stronger in compression. The fact that an appreciable quantity of the solder is under compression force when the boardlock is pulled upwardly relative to the circuit board, results in the solder being able to withstand significantly greater pullout forces than it could in the absence of such compression loading of the solder. Applicant prefers to angle the ramp or abutment 72 at an appreciable angle A from the horizontal, the angle shown being about 22° and preferably being at least about 15°. Such angling assures that part of the abutment 72 lies closely below the lower surface of a circuit board for boards of a range of thicknesses such as between about 54 and 70 thousandths inch.

Applicant has designed a boardlock of the construction shown, with an overall height between the bottom and the bent-over tabs 54 of 0.185 inch (4.70 mm). The boardlock was designed to fit into a circuit board hole having a diameter of 0.109 (2.77 mm) and a flange hole of a diameter of 0.089 inch (2.26 mm). The relative shape of the parts of the boardlock are as shown in the figures.

Thus, the invention provides a connector which mounts facewise against a circuit board, with boardlocks of low cost that reliably mechanically and electrically connect the connector housing to the circuit board. The boardlock is formed from a piece of sheet metal that has opposite vertical edges and a vertical middle, the boardlock having at least one separation slot separating it into tubular upper and lower portions, with the separation slots preferably extending largely horizontally from each vertical edge. The tubular lower portion has edge regions below each separation slot, that are bent to a larger average radius of curvature than edge regions of the tubular upper portion lying above the slot. This allows the tubular lower portion to lie snugly within a larger diameter hole in the circuit board. The lower tubular portion has a projection in its vertical middle portion or middle, such as in the form of a bump, to center the tubular lower portion in the circuit board hole. The tubular lower portion has a pair of fingers that are bent to extend upwardly and radially outwardly with respect to the axis of the boardlock, so upper ends of the fingers which lie within the larger circuit board hole, can abut the lower surface of the housing flange. The boardlock has tapered bottom portions with slits forming abutments that lie closely below the lower surface of the circuit board, to provide compression resistance of solder therebetween to resist upward pullout of the boardlock from the circuit board.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector having a housing that includes at least one flange that mounts facewise against a circuit board, where the flange and board have aligned largely cylindrical holes, and said connector includes at least one boardlock extending along a vertical axis through said holes of said flange and board to lock them together, characterized by:

said board hole has a larger diameter than said flange hole;

said boardlock comprises a metal sheet which is bent to form largely tubular upper and lower hole-received portions received respectively in said flange hole and said board hole, with each hole-received portion having a pair of largely vertical edges that bear against the walls of a corresponding hole and with each largely tubular board-received portion having a vertical axis;

said boardlock having a pair of separation slots lying between parts of said tubular upper and lower portions, each separation slot extending largely horizontally from one of said vertical edges and partially around said sheet so said slots separate parts of said tubular upper and lower portions into upper and lower edge regions, with each upper edge region lying above one of said slots and each lower edge region lying below one of said slots, and with each of said lower edge regions of said tubular lower portion having a larger average radius of curvature than each corresponding upper edge region of said tubular upper portion.

2. The connector described in claim 1 wherein:

said boardlock has a vertical middle lying about halfway between said vertical edge regions, with the portion of said vertical middle of said tubular lower portion having a projection that projects to a greater distance from said axis than areas of said vertical middle that surround said projection.

3. The connector described in claim 2 wherein:

said projection is in the form of a bump in said vertical middle.

4. The connector described in claim 1 wherein:

said metal sheet includes a bottom tapered portion which lies below said tubular lower portion and which is tapered to enable insertion downwardly through said circuit board, said tapered portion including at least two separate parts each inclined to extend downwardly and toward said boardlock vertical axis;

each of said tapered parts has an edge and has a slit extending largely horizontally into said edge and forming a bottom tab lying below said slit and having a largely upwardly-facing abutment;

said tubular lower portion lies in said circuit board hole, with said board having upper and lower faces, and each of said slit edges has a portion lying slightly below said circuit board lower face;

said board includes metal plating covering the walls of said board hole and extending over portions of each of said board faces; and including a quantity of solder joining said circuit board plating to said boardlock, with a trapped portion of said solder lying between said largely upwardly-facing abutment of said bottom tab and said lower board face, whereby upward pullout of said boardlock is resisted by compression of said trapped portion of said solder.

5. The connector described in claim 4 wherein:

said upwardly-facing abutment of said tab extends at an upward incline from said edge, of at least 15°.

6. The connector described in claim 1 wherein:

said boardlock lies with said tubular upper portion lying in said flange hole and said tubular lower portion lying in said board hole;

said tubular lower portion having a pair of largely vertical slits along each of said separation slots forming a finger, with each finger bent so its upper end lies further from said axis than its lower end:

the upper end of each said finger lying in said circuit board hole and substantially abutting the lower face of said flange.

7. A method for attaching a flange on a connector housing to a circuit board, where the flange has a through hole of a first diameter, by forming a hole in said circuit board, and by forming a boardlock from a piece of sheet metal and bending much of the piece of sheet metal into a largely tubular shape having an axis and having a vertical middle and with largely vertical edges that lie on a side of said axis substantially opposite said middle and pressing the bent boardlock downwardly through said flange and circuit board holes, characterized by:

said step of forming said circuit board hole including forming it with a second diameter that is larger than said first diameter of said flange hole;

said step of forming said boardlock includes forming at least one primarily horizontal separation slot in said sheet metal to separate said sheet metal into largely tubular upper and lower portions that lie respectively in said flange hole and in said circuit board hole;

bending said tubular lower portion so a lower edge region thereof that lies beneath said separation slot is bent to a larger average radius of curvature than an upper edge region of said boardlock that lies above said separation slot, so each of said tubular portions firmly engages the walls of a corresponding one of said holes.

8. The method described in claim 7 wherein:

said step of forming said separation slot includes forming two separation slots, each extending largely horizontally from one of said vertical edges to a location spaced from said vertical middle, and said step of bending said lower portion includes bending each lower edge region that lies under one of said separation slots, to a larger radius of curvature than a middle of said lower portion that lies between said edge regions.

9. The method described in claim 8 including:

forming a protuberance in said middle part of said tubular lower portion.

10. The method described in claim 7 including:

forming said board hole so it includes a layer of metal on the walls of the board hole;

forming a pair of largely vertical finger-forming slits in the lower edge of each said separation slot to form a pair of fingers, and bending said fingers to extend at an upward and radially-outward incline, so the upper ends of said fingers lie firmly against walls of said plated board hole and substantially against the lower surface of said flange.

11. A boardlock for locking a connector to a circuit board or the like comprising:

a piece of sheet metal having upper and lower ends, opposite largely vertically extending edges, and a vertically extending middle;

said piece of sheet metal having a pair of largely horizontal separation slots each extending largely horizontally from one of said largely vertical edges to a location spaced from said vertical middle, to divide part of said piece of sheet metal into upper and lower hole-receivable portions lying respectively above and below the height of said separation slots;

said upper and lower hole-receivable portions each have their vertical middles bent to approximately the same first radius of curvature, with upper edge regions of said upper portion lying above said separation slots having about said first radius of curvature, but with lower edge regions of said lower portion that lie beneath each of said separation slots each being bent to a greater average radius of curvature than said first radius;

said boardlock having an axis substantially centered on said first radius of curvature of said upper portion;

said middle of said lower portion has a projection that projects to a greater distance from said axis that adjacent portions of said middle of said lower portion.

12. The boardlock described in claim 11 wherein:

said piece of sheet metal has a pair of largely vertical slits in the lower edge of each said separation slot, to form a pair of fingers, each finger being bent at an upward-radially outward incline, whereby when said upper hole-received portion lies in a hole of an upper element, each finger can lie in a larger hole of a lower element and abut both the walls of said larger hole and the bottom surface of said upper element.

13. A combination circuit board and electrical connector comprising:

a connector having a housing with a first hole of a first diameter and having a lower housing surface around said hole;

a circuit board having a second hole of a second diameter that is at least 5 percent greater than said first diameter;

a boardlock having an axis and projecting through both of said holes, said boardlock having tubular upper and lower portions lying respectively in said first and second holes, said tubular lower portion having at least one finger projecting at an upward-outward incline and having an upper end lying substantially against said connector housing lower surface.

14. The combination described in claim 13 wherein:

said boardlock is formed of a piece of sheet metal which is bent largely around said axis to form said tubular upper and lower portions, with each portion having a largely vertical edge, said piece of sheet metal having a pair of separation slots extending largely horizontally from one of said edges so said separation slots separate parts of said tubular upper and lower portions into upper and lower edge regions, with each upper edge region lying above one of said slots and each lower edge region lying below one of said slots, and with each of said lower edge regions of said tubular lower portion having a larger average radius of curvature than each corresponding upper edge region of said tubular upper portion.

* * * * *